United States Patent [19]

Martin

[11] 4,281,820

[45] Aug. 4, 1981

[54] LIFTING JACK FOR VEHICLES OR THE LIKE

[76] Inventor: Coy J. Martin, P.O. Box 1811, Hickory, N.C. 28601

[21] Appl. No.: 107,444

[22] Filed: Dec. 26, 1979

[51] Int. Cl.[3] ..... B66F 3/00

[52] U.S. Cl. ..... 254/133 R

[58] Field of Search ..... 254/133, 134, 98, 99, 254/100, 101, 103, 108–112, DIG. 4

[56] References Cited

U.S. PATENT DOCUMENTS

| | | | |
|---|---|---|---|
| 641,490 | 1/1900 | Bauer | 254/103 |
| 1,378,900 | 5/1921 | Quinn | 254/103 |
| 1,715,897 | 6/1929 | Burkholder | 254/100 |
| 2,230,534 | 2/1941 | Elmer et al. | 254/133 R X |
| 2,469,670 | 5/1949 | Thompson | 254/134 |
| 3,314,656 | 4/1967 | Haines | 254/103 |
| 3,990,592 | 11/1976 | Migliano | 254/133 R X |
| 4,066,243 | 1/1978 | Johnson | 254/133 R |

*Primary Examiner*—Robert C. Watson

*Attorney, Agent, or Firm*—Richards, Shefte & Pinckney

[57] ABSTRACT

A vehicle lifting jack having a jack shaft, a load lifting assembly supported on and operably associated therewith for vertical movement therealong, and an improved load engaging member pivotably affixed to the load lifting assembly. The load engaging member includes a stabilizing torque arm having a roller at the extending end thereof for bearing engagement of the shaft to isolate torque created during operation to the load engaging member and direct such torque to the shaft, thereby preventing rotation of the load lifting assembly with respect to the shaft. To prevent damage to the vehicle bumper during operation, the load engaging member also includes a cantilevered portion, a vehicle frame engaging element extending upwardly therefrom for liftingly engaging the vehicle frame, and a bumper engaging element for cushioned abutting contact with the vehicle bumper during operation.

8 Claims, 4 Drawing Figures

FIG. 1
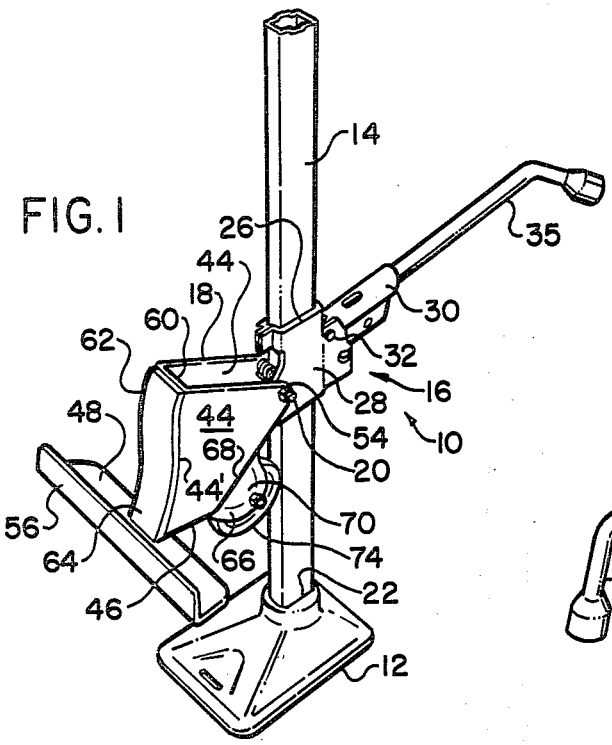
FIG. 2
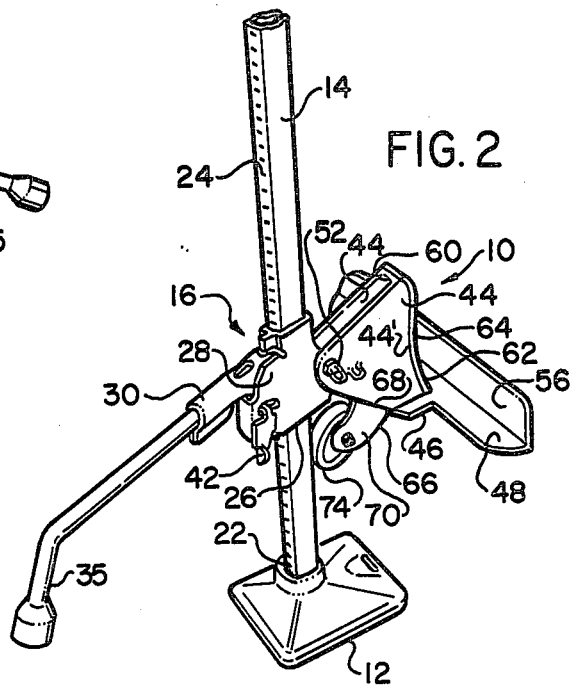
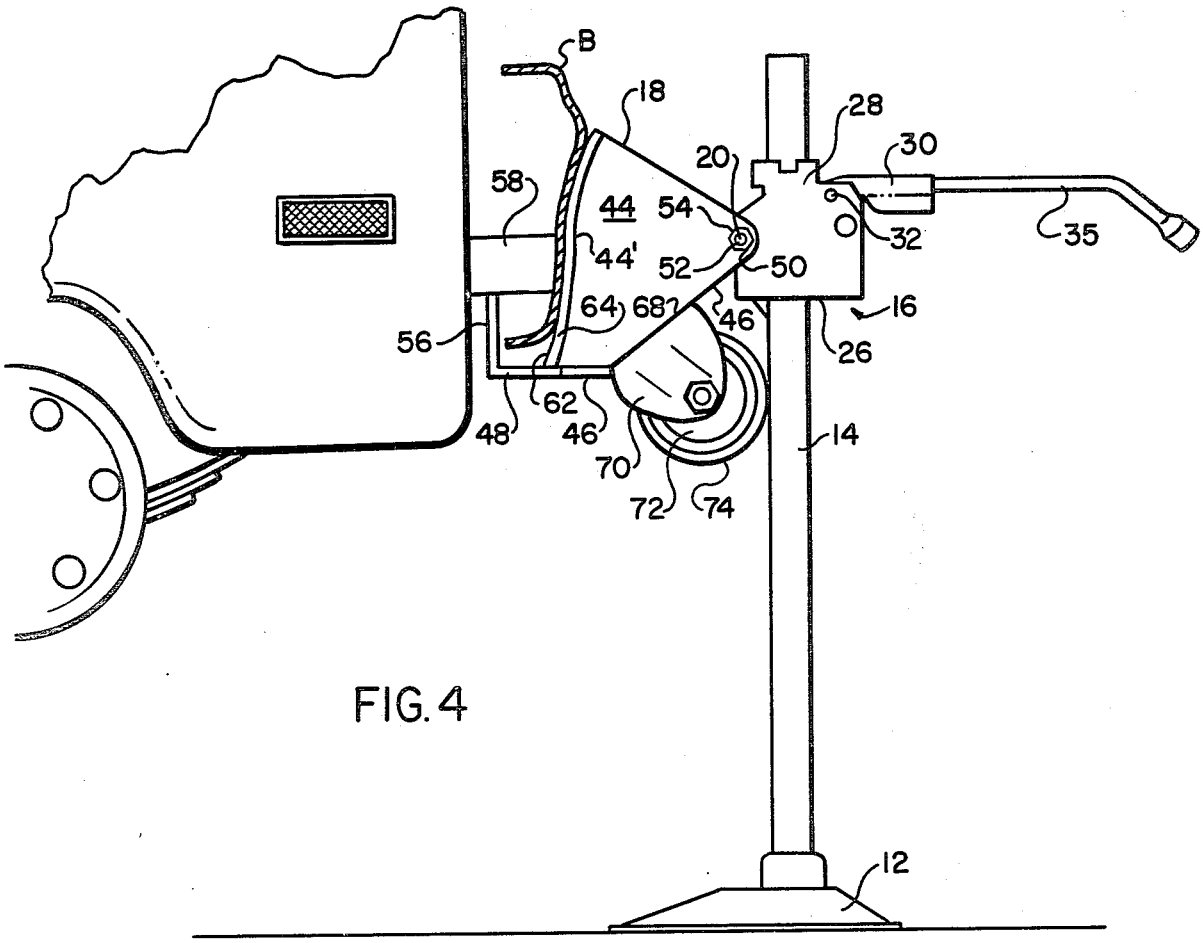
FIG. 4

LIFTING JACK FOR VEHICLES OR THE LIKE

BACKGROUND OF THE INVENTION

The present invention relates to lifting jacks, and more particularly to lifting jacks of the type designed for use with vehicles, especially those vehicles having a bumper affixed to and extending from the frame thereof.

The use of lifting jacks with vehicles of various types is well known, most vehicles traditionally being provided with a lifting jack as a standard accessory thereto to facilitate the performance of certain minor repairs requiring the raising of a portion of the vehicle, such as the removal and replacement of wheels and tires. Typically, such standard vehicle jacks include an upright jack shaft, a load lifting assembly supported on and operably associated with the shaft for vertical movement therealong, and a bumper engaging member attached or affixed to the load lifting assembly to provide mechanical interconnection between the vehicle and the load lifting assembly of the jack. Various mechanical arrangements are utilized in the load lifting assemblies of such jacks to provide a means of operably associating the load lifting assembly with the jack shaft. In the vast majority of conventional jacks, the load lifting assembly includes a ratchet mechanism shiftably engagable with teeth formed in and arranged vertically on the jack shaft for effecting movement of the load lifting assembly vertically along the shaft. Lucker U.S. Pat. No. 2,743,903 and Achterberg U.S. Pat. No. 3,110,475 are examples of this type of conventional jack. In other conventional jacks, the upright jack shaft includes a threaded screw rotatable about a vertical axis, the load lifting assembly in such jacks being correspondingly threaded internally to permit mounting thereof on the screw of the jack shaft and to facilitate vertical movement of the lifting assembly along the shaft upon rotation of the screw. Examples of such conventional jacks are disclosed in Kelleher U.S. Pat. No. 2,013,918 and Lucker U.S. Pat. No.

As will be understood by those skilled in the art, when a load is applied to the load lifting assembly of any of these conventional jacks, such as occurs when the bumper engaging member thereof is brought into lifting engagement with the bumper of a vehicle during a lifting operation, torque is exerted upon the load lifting assembly causing it to rotate or pivot with respect to the jack shaft about a horizontal axis, thereby concentrating the frictional forces between the load lifting assembly and the jack shaft at a relatively small number of points of frictional contact therebetween. Since the various components of conventional jacks of this type are normally constructed of relatively strong, thick metal stock, such jacks nevertheless operate generally satisfactorily when utilized to lift automobiles or other relatively lightweight vehicles, the primary effect of the torque and resulting concentration of frictional forces created during operation of such jacks being to increase the amount of physical exertion required of the jack operator.

As a result of this inherent disadvantage in conventional jacks, certain modifications in conventional jacks have heretofore been suggested to attempt to reduce the frictional forces created during operation thereof. The use of a roller mounted in the load lifting assembly at one of the points at which the lifting assembly frictionally contacts the jack shaft during loading is proposed in each of the above-mentioned Lucker patents. However, the existence and effect of torque on the load lifting assembly during loading thereof are in no way alleviated in such jacks. In fact, the creation of torque in the load lifting assemblies of these jacks during loading thereof is actually designed into such jacks in order to insure the occurrence of contact between the roller and the jack shaft during the lifting operation. Thus, instead of alleviating the creation of torque in the load lifting assembly of such jacks, such provisions merely effect a substitution of rotational frictional contact between the roller and the jack shaft during loading for the sliding frictional contact which would occur between the load lifting assembly and the jack shaft if no such roller were utilized. At best, such provisions merely somewhat reduce the amount of friction created by the torque which results during loading.

It is the existence and effect of torque in the operation of conventional jacks of all types that renders them generally unsatisfactory, if not inoperable, for use with vehicles such as vans, heavy duty utility vehicles such as "pick-up" trucks and the like, and recreational vehicles and the like, which are generally substantially heavier than automobiles. The heavier load which such vehicles place upon the load lifting assembly of such jacks exerts a greater amount of torque on such assembly thereby also creating greater frictional forces. In certain instances, such jacks are wholly inoperative for lifting such vehicles and attempts to so use such jacks result only in the deformation or disfigurement of the vehicle bumper. While such conventional jacks may be operable in other instances to lift certain of such vehicles, a relatively great degree of physical exertion is required of the operator to overcome the frictional forces created and, in most instances, deformation or disfigurement of the bumper nevertheless results. For this reason, vans, recreational vehicles and other such heavier vehicles are not generally provided with an accessory bumper jack but are instead normally provided with a jack designed for lifting engagement of the vehicle axle which must be positioned and operated from below the axle of the vehicle.

In contrast to the above, the present invention provides a lifting jack specifically designed to isolate the effect of torque created during loading and to direct such torque to the jack shaft in a manner substantially preventing rotational movement of the load lifting assembly of the jack with respect to the shaft and reducing the friction therebetween. The present invention also provides a lifting jack which may be used with vans, recreational vehicles and the like in a manner substantially similar to conventional bumper jacks without distorting or disfiguring the bumpers of such vehicles.

SUMMARY OF THE INVENTION

The present invention provides an improved load engaging member for lifting jacks of the type having an upright jack shaft and load lifting means supported on and operably associated with the shaft for vertical movement therealong. According to one feature of the present invention, the load engaging member is pivotably affixed to the load lifting means for movement therewith along the shaft and is engagable with a load to be moved vertically to effect vertical movement of such load. Affixed to and extending from the load engaging member is a stabilizing torque arm having a bearing portion thereon for bearing engagement of the upright shaft, the bearing portion being moveable along the shaft in such bearing engagement therewith upon vertical movement of the load lifting means therealong. In this manner, the effect of the torque created during loading is substantially isolated to the load engaging member and such torque is directed to the shaft through the stabilizing arm thereby substantially preventing rotational movement of the load lifting means with respect to the shaft and reducing the friction therebetween.

In the preferred embodiment of the present invention, the bearing portion comprises a bearing element in the form of a roller rotatably mounted on the extending portion of the stabilizing arm for rotational bearing engagement of the jack shaft at a vertical spacing from the load lifting means and rotatably moveable along the shaft in such bearing engagement therewith upon vertical movement of the load lifting means therealong. Preferably, the stabilizing torque arm depends from the load engaging member for bearing engagement of the shaft at a downward spacing from the load lifting means.

Further, the load engaging member of the present invention provides an improvement in lifting jacks for vehicles having a bumper affixed to and extending from the frame thereof. In accordance with this feature of the present invention, the load engaging member has a cantilevered portion extending generally laterally outwardly of the shaft for disposition below the vehicle bumper and a vehicle frame engaging element extending generally upwardly from the cantilevered portion for liftingly engaging the vehicle frame to effect vertical movement thereof.

In the preferred embodiment of the present invention, the vehicle frame engaging element extends sufficiently vertically from the centilevered portion to maintain the cantilevered portion out of engagement with the vehicle bumper during engagement of the frame by the vehicle frame engaging element. The load engaging member also preferably includes a bumber engaging element affixed to and extending upwardly from the cantilevered portion intermediate the load lifting means and the vehicle frame engaging element. The bumper engaging element is contoured to generally conform to the shape of the vehicle bumper and has a resilient bumper engaging surface for cushioned abutting contact with the bumper upon engagement of the vehicle frame by the vehicle frame engaging element to prevent damage or deformation of the bumper during such engagement.

BRIEF DESCRIPTION OF THE DRAWINGS

FIG. 1 is a perspective view of the preferred embodiment of the lifting jack of the present invention;

FIG. 2 is another perspective view of the lifting jack of FIG. 1 taken from a different perspective;

FIG. 4 is a side elevational view of the lifting jack of FIG. 1 in lifting engagement with a vehicle.

DESCRIPTION OF THE PREFERRED EMBODIMENT

Figure 3:
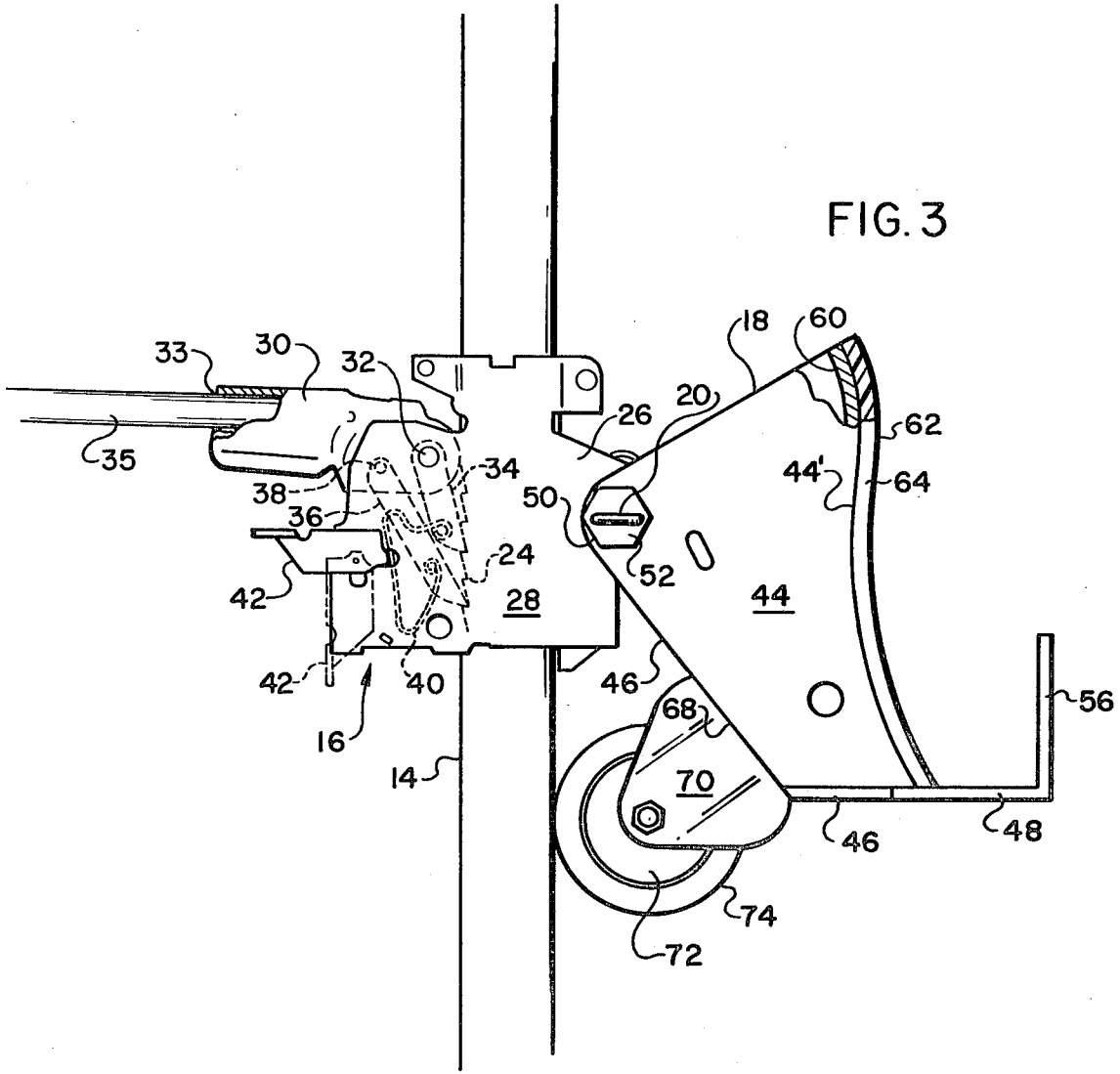
FIG. 3 is a side elevational view of the lifting jack of FIG. 1.

Referring now to the accompanying drawings, the improvement in lifting jacks provided by the present invention is herein illustrated and described in accordance with the preferred embodiment thereof in a ratchet-type vehicle jack, generally indicated at 10 in FIG. 1. As is conventional, the jack 10 includes a base plate 12 which receives and supports an upright jack shaft 14, and a load lifting assembly, indicated generally at 16, supported on and operably associated with the jack shaft 14 in a manner hereinafter more fully described for vertical movement therealong. A load engaging member 18 is pivotably affixed to the load lifting assembly 16 at 20 for movement therewith along the shaft 14.

The upright jack shaft 14 is preferably formed of tubular metal and is preferably of generally rectangular or trapezoidal-shaped cross-section. The base plate 12 is also preferably formed of metal, is of substantially rectangular shape, and is provided generally centrally thereon with an opening 22 shaped correspondingly with the cross-sectional shape of the shaft 14 for receiving the lower end thereof to thereby support the shaft 14 in an upright position. A plurality of teeth 24 are formed in and extend vertically along one side of the shaft 14 for cooperating with the load lifting assembly 16 in a manner to be now described.

The load lifting assembly 16 is generally of the same conventional construction illustrated and described in the aforementioned Lucker U.S. Pat. No. 2,743,903 and Achterberg U.S. Pat. No. 3,110,475, and comprises a housing 26 preferably formed from sheet metal and having opposite side walls 28 between which extends the shaft 14. The load lifting assembly 16 is provided with an actuating mechanism for effecting vertical movement thereof along the shaft 14, the actuating mechanism including a lever 30 pivotably supported between the housing side walls 28 on a pin 32. The operating lever 30 includes a tubular portion 33 extending outwardly of the housing 26 for receiving therein a rod 35 or other handle for operating the actuating mechanism. Also pivotably supported by the pin 32 is a first pawl 34 which depends therefrom for engagement with the teeth 24 of the shaft 14. A second pawl 36 of greater length than the first pawl 34 is pivotably affixed at 38 on the actuating lever 30 and depends therefrom for engagement with the teeth 24 at a downward spacing from the first pawl 34. A spring 40 is pivotably connected at one end thereof to the pawl 34 and at the other end thereof to the pawl 36. Also mounted on the housing 26 is a finger 42, the finger 42 being moveable between the position thereof illustrated in full lines in FIG. 3, in which it engages the spring 40, and a position out of engagement with the spring 40, such position being illustrated in broken lines in FIG. 3.

When the finger 42 is in engagement with the spring 40, the spring 40 biases both pawls 34 and 36 into engagement with respective teeth 24 on the shaft 14. To move the housing 26 upwardly along the shaft 14, the actuating lever 30 is first raised, thereby maintaining the pawl 34 in engagement with the tooth of the shaft 14 into which it is biased by the spring 40 and thus preventing downward movement of the housing 26 while lifting and advancing the pawl 36 upwardly one tooth. Upon subsequent downward movement of the actuating lever 30, downward force is exerted on the pawl 36 causing it to remain in engagement with the tooth into which it advanced immediately therebefore, thereby preventing downward movement of the housing 26, while the pawl 34 is lifted and advanced upwardly one tooth. The lowering of the housing 26 is effected by moving the finger 42 to the moved position indicated in FIG. 3 to disengage it from the spring 40 and performing the above-described upward and downward movement of the actuating lever 30.

As hereinbefore mentioned, the load engaging member 18 is pivotably affixed to the load lifting assembly 16 at 20. Preferably, the pivotal connection between the load engaging member 18 and the load lifting assembly 16 is disengagable. To facilitate such interconnection, the load engaging member 18 is constructed of two sheet metal side plates 44 joined by a lower wall 46 extending transversely between the lower edges thereof at a spacing slightly greater than the spacing between the side walls 28 of the load lifting assembly 16, and each of the plates 44 and walls 28 have a circular hole 50 bored therethrough at respectively corresponding locations thereon. The load engaging member 18 is thus mounted on the load lifting assembly 16 with the side plates 44 overlapping the walls 28 so as to align each of the holes 50 thereof and a bolt 52 extending therethrough and secured by a nut 54.

As has been hereinbefore mentioned, the jack 10 of the present invention is designed to be used with vehicles in a manner substantially similar to conventional bumper jacks without distorting or disfiguring the bumper of the vehicle. For this purpose, the load engaging member 18 includes a cantilevered portion 48 of substantially greater width than the lower wall 46 extending laterally outwardly of the shaft 14 from the lower wall 46 and a vehicle frame engaging element 56 of corresponding width extending generally upwardly from the outwardly facing edge of the cantilevered portion 48. As can be seen in FIG. 4, the jack 10 may thus be operated in the conventional manner of standard bumper jacks by first positioning it adjacent the bumper B of a vehicle to be lifted with the cantilevered portion 48 disposed below the vehicle bumper B and the vehicle frame engaging element positioned below a member of the vehicle frame, such as the bumper bracing 58 in FIG. 4 by which the bumper B is affixed to the vehicle frame, and then operating the load lifting assembly 16 in the hereinbefore described manner to move the load engaging member 18 upwardly and bring the vehicle frame engaging element 56 into lifting engagement with the vehicle frame. The frame engaging element 56 is constructed of a sufficient height so as to extend sufficiently vertically from the cantilevered portion 48 to maintain the cantilevered portion 48 out of engagement with the vehicle bumper B during engagement of the bumper bracing 58 by the vehicle frame engaging element 56, thereby preventing damage to the bumper B during the lifting of the vehicle.

To provide a greater degree of stability of engagement between the load engaging member 18 and the vehicle during lifting thereof, the sides 44' of the side plates 44 facing outwardly of the jack shaft 14 and extending upwardly from the cantilevered portion 48 are contoured to generally conform to the shape of the bumper B of the vehicle with which the jack 10 is to be used, and such contoured sides are joined by a correspondingly contoured wall 60 affixed to and extending upwardly from the cantilevered portion 48 to provide a bumper engaging element 62 intermediate the load lifting assembly 16 and the vehicle frame engaging element 56 for abuttingly contacting the bumper B upon engagement of the bumper brace 58 by the frame engaging element 56. A cushioned pad 64 of rubber or other resilient material is affixed to and covers the outwardly facing surface of the contoured wall 60 to provide a resilient bumper engaging surface to cushion the abutting contact between the bumper B and the bumper engaging element 62 and thereby prevent damage or deformation of the bumper during a lifting operation. It has been found through trial use of the jack of the present invention on various makes and models of conventional vans that the load engaging member of the present invention is adaptable to the bumpers of most such vehicles.

The load engaging member 18 is also provided with a stabilizing torque arm 66 affixed to the lower wall 46 and extending therefrom in depending relation thereto toward the shaft 14. The stabilizing torque arm 66 is constructed of a unitary length of metal having two transverse bends 68 formed therein to provide a central portion by which the arm 66 is affixed to the lower wall 46 and two legs 70. The stabilizing torque arm 66 also includes a ball bearing assembly 72 rigidly affixed to the legs 70 intermediate the extending ends thereof. Rotatably supported on the ball bearing assembly 72 is a roller 74 which acts as a bearing portion or element of the stabilizing arm 66 for rotational bearing engagement of the jack shaft 14 at a downward vertical spacing from the load lifting assembly 16, and is rotatably moveable along the shaft 14 in such bearing engagement therewith upon vertical movement of the load lifting assembly 16.

As will be understood by those skilled in the art, upon lifting engagement of a vehicle by the load engaging member 18 of the present invention, the weight of the vehicle will exert a downward force on the load engaging member 18. As the load lifting assembly 16 is moved upwardly along the shaft 14 as hereinbefore described, thereby exerting through the load engaging member 18 an upward lifting force upon the vehicle frame, torque will be exerted on the load engaging member 18. In conventional devices not provided with the stabilizing torque arm 66 of the present invention, such torque will be transmitted to the load lifting assembly 16 causing it to rotate about the shaft 14, as has been hereinbefore described. However, in the present invention, the stabilizing torque arm 66 bearingly engages the shaft 14. In this manner, rotational movement of the load lifting assembly with respect to the shaft is substantially prevented. Instead, the load lifting assembly 16 is merely pulled horizontally toward the load engaging member 18 thereby essentially spreading the frictional contact between the shaft 14 and the load lifting assembly 16 across the entire rearwardly facing portion thereof, i.e. the portions thereof engaging the side of the shaft 14 opposite the load engaging member, and accordingly reducing the friction therebetween. As a result, significantly less effort is required of the jack operator when using the jack of the present invention as compared to conventional jacks.

It can be seen from the above description of the preferred embodiment of the present invention that the present invention is of broad utility and thus, as those skilled in the art will readily understand, may be adapted to other lifting jacks and apparatus without departing from the substance or scope of the present invention. Specifically, it is to be understood that the concepts of the present invention may be incorporated in any conventional vehicle bumper jack of the type having an upright jack shaft and a load lifting assembly supported thereon and operably associated therewith for vertical movement therealong. For example, the present invention could be utilized with a conventional screw-type jack as well as the ratchet-type jack described herein. Moreover, modifications and variations in the unique load engaging member of the present invention may be resorted to without departing from the substance or scope of the present invention. Therefore, although the present invention has been illustrated and described herein in relation to the preferred embodiment thereof, such modifications and variations are within the scope of the present invention, which is intended to be limited only by the appended claims and equivalents thereof.

I claim:

1. In a lifting jack of the type having an upright jack shaft and load lifting means supported on and operably associated with said shaft for vertical movement therealong, the improvement comprising a load engaging member pivotably affixed to said load lifting means generally vertically centrally thereof for movement therewith along said shaft and engagable with a load to be moved vertically to effect vertical movement of such load, said load engaging member having affixed thereto and extending therefrom a stabilizing torque arm having a bearing portion thereon for bearing engagement of said upright jack shaft and moveable along said shaft in such bearing engagement therewith upon vertical movement of said load lifting means therealong to substantially isolate the effect of the torque created during loading to said load engaging member and direct such torque to said shaft through said stabilizing arm thereby substantially preventing rotational movement of said load lifting means with respect to said shaft and reducing the friction therebetween.

2. The improvement in a lifting jack according to claim 1 and characterized further in that said bearing portion comprises a bearing element disposed on the extending portion of said stabilizing torque arm for bearing engagement of said upright jack shaft at a vertical spacing from said load lifting means.

3. The improvement in a lifting jack according to claim 2 and characterized further in that said bearing element is a roller rotatably mounted on the extending portion of said stabilizing torque arm for rotational bearing engagement of said upright shaft and rotatably moveable therealong in such bearing engagement therewith upon vertical movement of said load lifting means therealong.

4. The improvement in a lifting jack according to either claim 1, 2 or 3 and characterized further in that said stabilizing torque arm depends from said load engaging member for bearing engagement of said shaft at a downward spacing from said load lifting means.

5. The improvement in a lifting jack according to claim 1 and characterized further in that said load engaging member of said jack is adapted for use on vehicles having a bumper affixed to and extending from the frame thereof, said load engaging member having a cantilevered portion extending generally laterally outwardly of said shaft for disposition below the vehicle bumper and a vehicle frame engaging element extending generally upwardly from said centilevered portion for liftingly engaging the vehicle frame to effect vertical movement thereof.

6. The improvement in a lifting jack according to claim 5 and characterized further in that said vehicle frame engaging element extends sufficiently vertically from said cantilevered portion to maintain said cantilevered portion out of engagement with the vehicle bumper during engagement of the vehicle frame by said vehicle frame engaging element.

7. The improvement in a lifting jack according to claim 5 and characterized further in that said load engaging member includes a bumper engaging element affixed to and extending upwardly from said cantilevered portion intermediate said load lifting means and said vehicle frame engaging element and having a resilient bumper engaging surface for cushioned abutting contact with the vehicle bumper upon engagement of the vehicle frame by said vehicle frame engaging element to prevent damage or deformation of the bumper during such engagement.

8. The improvement in a lifting jack according to claim 7 and characterized further in that said bumper engaging surface is contoured to generally conform to the shape of the vehicle bumper.

* * * * *

UNITED STATES PATENT OFFICE

CERTIFICATE OF CORRECTION

Patent No. 4,281,820 Dated August 4, 1981

Inventor(s) Coy J. Martin

It is certified that error appears in the above-identified patent and that said Letters Patent are hereby corrected as shown below:

Column 1, line 40, after "No." insert --2,980,397--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*